US007004792B2

(12) United States Patent
Shimizu

(10) Patent No.: US 7,004,792 B2
(45) Date of Patent: Feb. 28, 2006

(54) ELECTRICAL CONNECTOR

(75) Inventor: Shinji Shimizu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/959,337

(22) Filed: Oct. 7, 2004

(65) Prior Publication Data

US 2005/0118879 A1 Jun. 2, 2005

(30) Foreign Application Priority Data

Nov. 28, 2003 (JP) ..... 2003-398496

(51) Int. Cl.
*H01R 13/648* (2006.01)

(52) U.S. Cl. ..... 439/607; 439/660

(58) Field of Classification Search ..... 439/607, 439/608, 609, 108, 660, 79
See application file for complete search history.

(56) References Cited

U.S. PATENT DOCUMENTS

| | | | | |
|---|---|---|---|---|
| 6,652,317 | B1 * | 11/2003 | Shao | 439/607 |
| 6,685,508 | B1 * | 2/2004 | Zhu et al. | 439/607 |
| 6,688,915 | B1 * | 2/2004 | Moriwake et al. | 439/607 |
| 6,843,665 | B1 * | 1/2005 | Motojima et al. | 439/108 |
| 2001/0053630 | A1 * | 12/2001 | Shi et al. | 439/607 |
| 2002/0142657 | A1 * | 10/2002 | Nishio et al. | 439/607 |
| 2003/0157836 | A1 * | 8/2003 | Morikawa et al. | 439/607 |
| 2004/0102093 | A1 * | 5/2004 | Huang | 439/607 |
| 2004/0192111 | A1 * | 9/2004 | Wu | 439/607 |

FOREIGN PATENT DOCUMENTS

JP 5-94847 4/1993

* cited by examiner

*Primary Examiner*—Hien Vu
(74) *Attorney, Agent, or Firm*—Takeuchi&Kubotera, LLP

(57) ABSTRACT

An electrical connector includes a plurality of terminals (1) having contact sections (4) extending in the plugging direction and arranged in the arranging sections at a predetermined intervals for contact with the contact sections (32A) of a mating connector (30). The arranging section is made in the inside surface of a single wall of the housing.

5 Claims, 8 Drawing Sheets

ELECTRICAL CONNECTOR

BACKGROUND OF THE INVENTION

1. Field of the Invention

The present invention relates to electrical connectors and, particularly, to an electrical connector to be attached to a circuit board.

2. Description of the Related Art

JP 05-94847 discloses an electrical connector of this type. The connector includes a board connector to be attached to a circuit board and an external connector to be plugged to the connector in a direction parallel to the circuit board. The board connector includes a tubular shield case and a housing spaced within the shield case and having an arranging plate in the back side of which the contact sections of terminals are arranged. The external connector includes a housing with a receiving cavity for receiving the arranging plate and a shield case surrounding the housing. The U-shaped contact sections of terminals are provided in the receiving cavity for pressing the arranging plate upon plugging.

There is a strong demand for miniaturization of electronics devices, especially, low-profile electronics components including electrical connectors. The afore-mentioned electrical connector, however, failed to meet the low-file requirement. The connector on a circuit board must have a receiving space around the arranging plate for receiving a mating connector and the mating connector must have a projection section with a receiving cavity for receiving the arranging plate, resulting in the high-profile connectors.

SUMMARY OF THE INVENTION

Accordingly, it is an object of the invention to provide a low-profile connector to be mounted on a circuit board.

The invention relates to an electrical connector comprising a housing having an outer wall with at least one arranging section at a predetermined interval and at least one terminal having a contact section provided in the arranging section and brought into contact with a contact section of a mating connector upon plugging operation.

According to the invention, the arranging section is provided in an inner side of the outer wall of the housing. There is no wall corresponding to the outer wall so that the height of the connector is reduced by the thickness of another wall.

The electrical connector is a receptacle connector provided on a circuit board for receiving a mating connector in a direction parallel to the circuit board or a plug connector to be connected to a receptacle connector in a direction parallel to a circuit board on which the receptacle connector is provided.

The contact section of the terminal is raised from the arranging section and is made flexible or fixed closely to a bottom of the arranging section. For the fixed contact section, the arranging section is an arranging groove having a depth sufficiently deep to house the contact section therein so that no finger or the like can touch the contact section accidentally.

The electrical connector further comprises a shield case for covering the housing so as to facilitate guiding and supporting the mating connector. The shield sheet is so thin that its thickness hardly affects the height.

The housing includes a housing body and a holding member to form a retention section for retaining an intermediate portion of the terminal, the housing body having a retention groove communicating with the arranging groove.

This structure eliminates the difficult task that a curved terminal is inserted into an aperture in the housing.

According to the invention, the contact section of a terminal is arranged on a single wall of a housing so that no opposed wall is required, thus minimizing the height of the connector. The shield case, which is made of a metal sheet and provided on the housing, working as an opposed wall to the single wall, not only hardly increases the height of the connector but also facilitates the plugging of a mating connector.

FIRST EMBODIMENT

Figure 1:
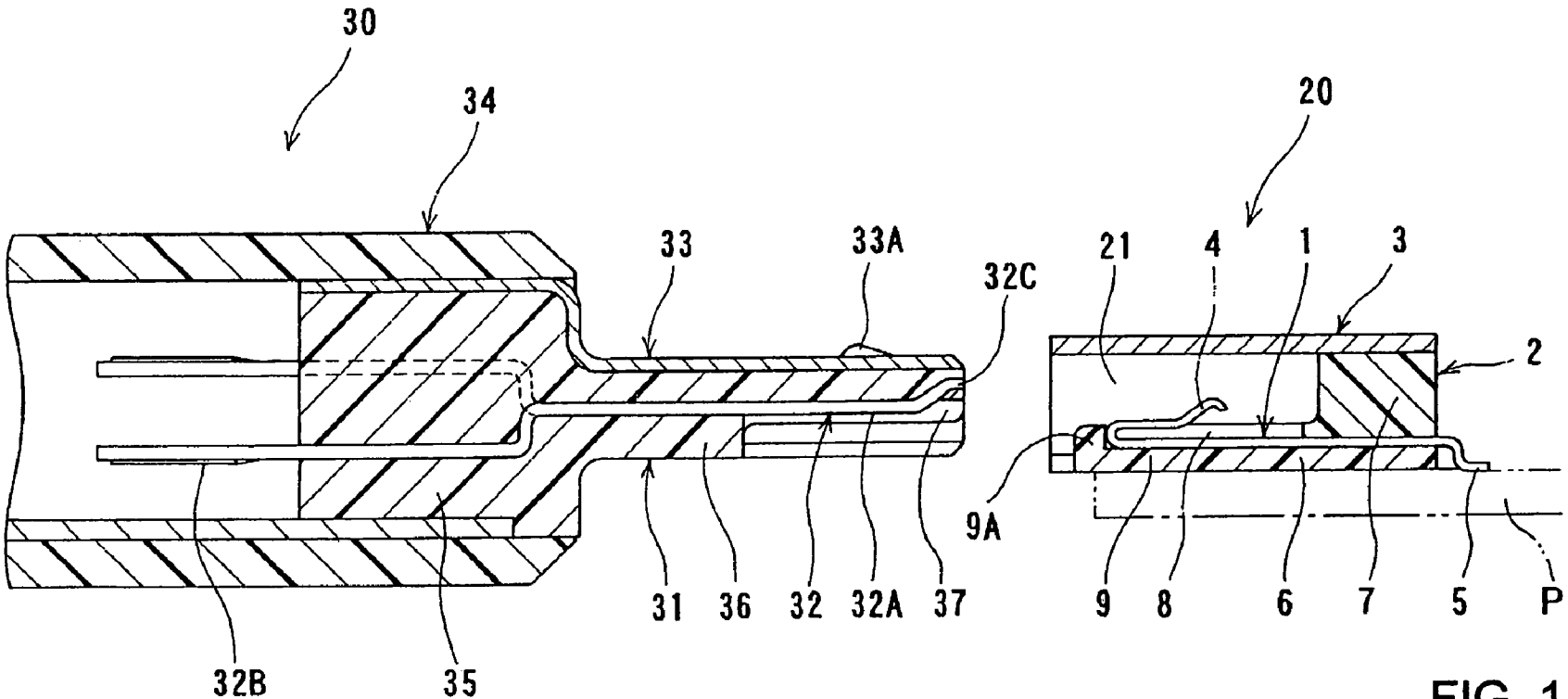
FIG. 1 is a sectional view of a receptacle connector and a plug connector according to the first embodiment of the invention.
Figure 2:
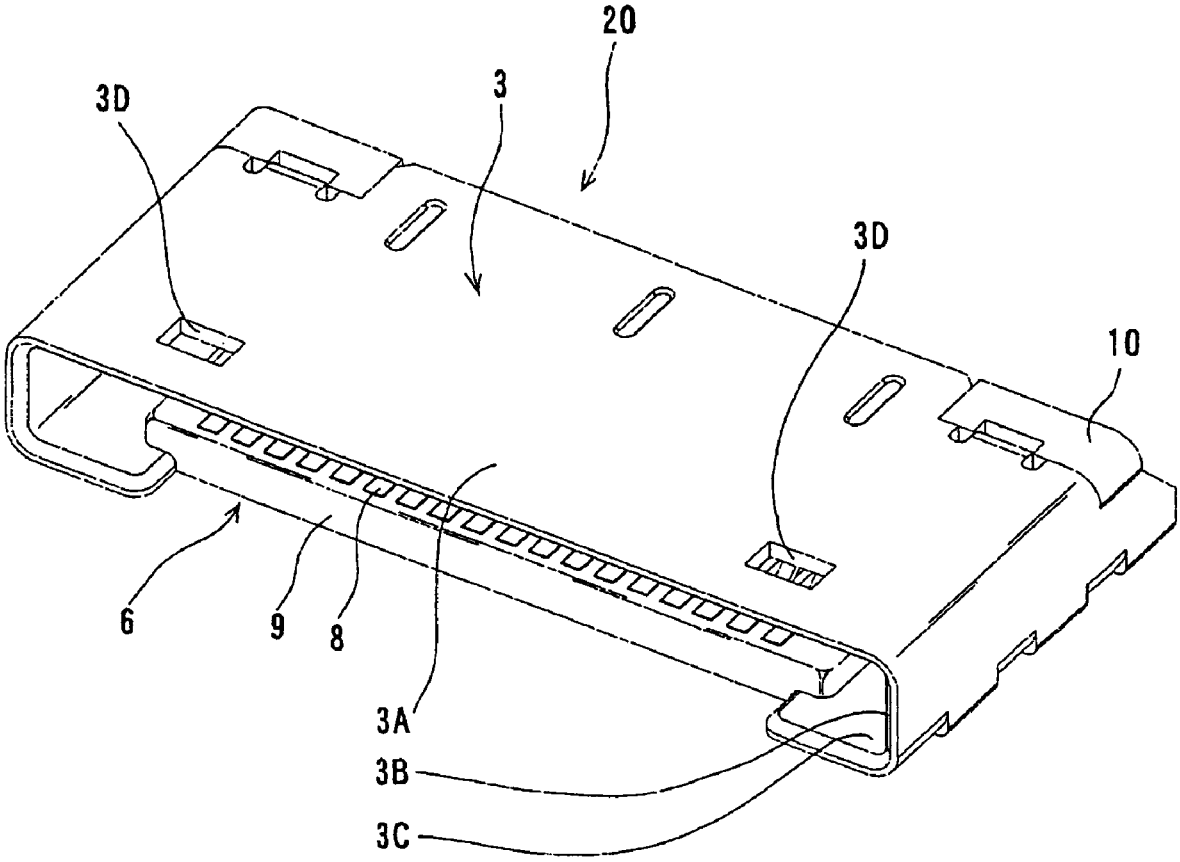
FIG. 2 is a perspective view of the receptacle connector.

In FIGS. 1–4, a receptacle connector 20 is attached to the edge of a circuit board P so as to receive a plug connector 30. The receptacle connector 20 has an opening for receiving the plug connector 30 in a direction parallel to the circuit board P. The receptacle connector 20 includes a terminal 1, a housing 2, and a shield case 3.

The terminal 1 is made by bending a strip of metal to provide a front contact section 4 and a rear connection section 5. The contact section 4 is made by folding back the front portion of the terminal 1 and then raising its tip obliquely upwardly with the rear end rounded. The connection section 5 is made by bending the rear portion downwardly and then horizontally for contact with the circuit board.

Figure 3:
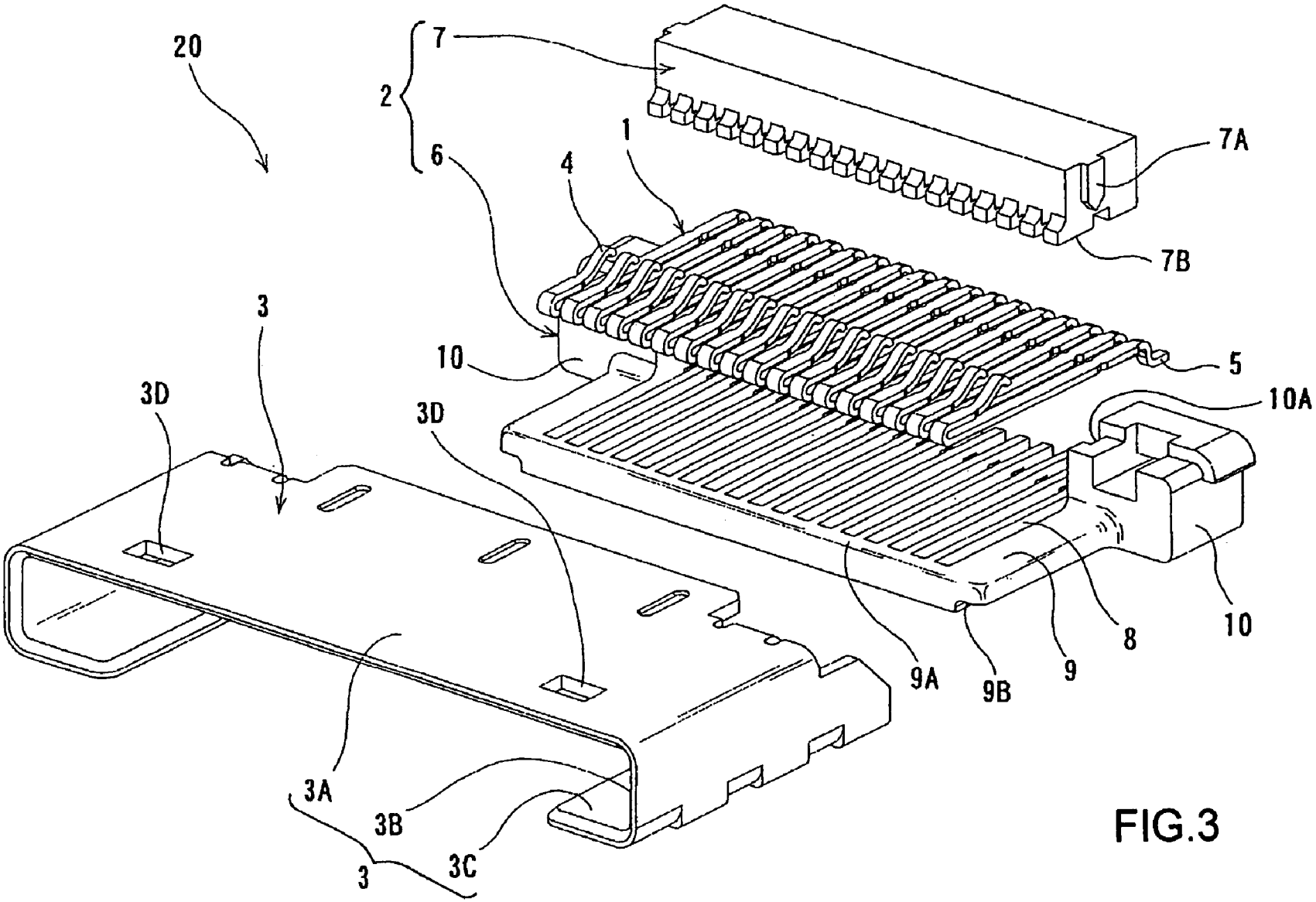
FIG. 3 is an exploded perspective view of the receptacle connector.

The housing 2 is made of an insulative material, such as a plastic, so as to provide a housing body 6 and a holding member 7. The housing body 6 includes an arranging plate 9 in which a plurality of parallel arranging grooves 8 is provided, and a pair of fixing blocks 10 provided on opposite rear ends of the arranging plate 9 (FIG. 3). Each arranging groove 8 extends from the front edge 9A to the rear end of the arranging plate 9. The arranging groove 8 has a depth sufficiently deep to accommodate the terminal 1 but the resilient U-shaped contact section 4 projects upwardly from the arranging groove 8. A pair of indentations 9B extends along opposite lower sides of the arranging plate 9. The fixing block 10 extends upwardly and laterally from the arranging plate 9 and has a vertical guiding groove 10A in the inner side thereof.

The holding member 7 fits in a space between the fixing blocks 10 so as to be flat with the fixing blocks 10. A pair of vertical guided projections 7A is provided on opposite sides of the holding member 7 to be guided by the guiding grooves 10A. The lower ends of the guided projections 7A are tapered so as to facilitate insertion into the guiding grooves 10A. A plurality of projections 7B is provided on the lower face of the holding member 7 so as to fit in the respective arranging grooves 8 to retain the terminals without failure. Consequently, the arranging grooves 8 work as holding grooves in the range corresponding to the holding member 7. Thus, it is possible to fix the terminals to the housing even if the terminals have a U-shaped fronts and crank-shaped rear portions and are difficult to insert into terminal apertures. The U-shaped contact sections of the short terminals are able to provide satisfactory contact forces.

The shield case 3 is made by bending and forming a metal sheet to provide an upper face 3A, side faces 3B, and lower faces 3C so as to cover the top of the holding member 7, the sides of the fixing blocks 10, and the lower edges of the housing 2. The lower faces 3C of the shield case 3 fit in the indentations 9B of the arranging plate 9 so that not only the height of the connector is reduced by the thickness of the lower face 3C but also the arranging plate is reinforced. When the shield case 3 is attached to the housing 2, it forms an inner receiving space 21 above the arranging grooves 8 and to the sides of the arranging plate 9 for receiving a mating connector.

A pair of lock holes 3D is provided in the top face 3A of the shield case 3 for engagement with locks of the plug connector 30 as described hereinafter.

The terminal 1 is placed in the arranging groove 8 of the housing body 6, and the holding member 7 is placed between the fixing blocks 10 such that the guided projections 7A are guided by the guiding grooves 10A of the fixing blocks 10. The projections 7A of the holding member 7 fit in the arranging grooves 8 to firmly hold the terminals 1 in the arranging grooves 8. Then, the shield case 3 is attached to the housing 2 so as to cover the housing body 6, the fixing blocks 10, and the holding member 7.

Figure 4A:
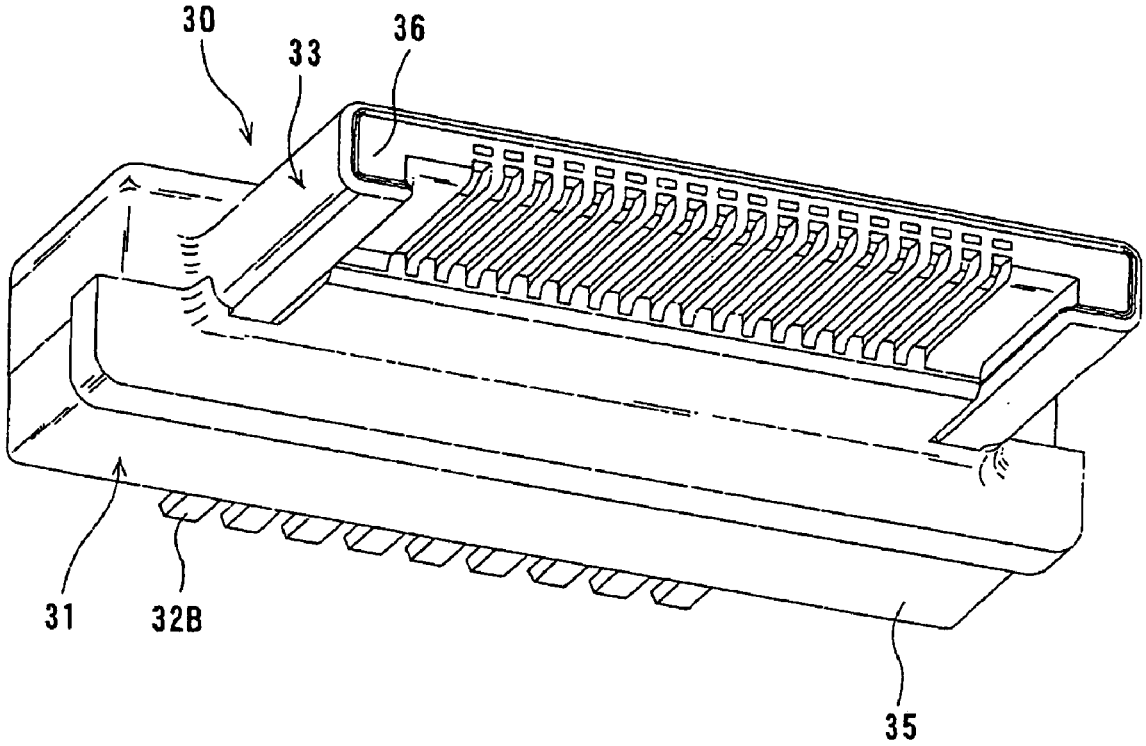
FIG. 4(A) is a perspective view of the plug connector.
Figure 4:
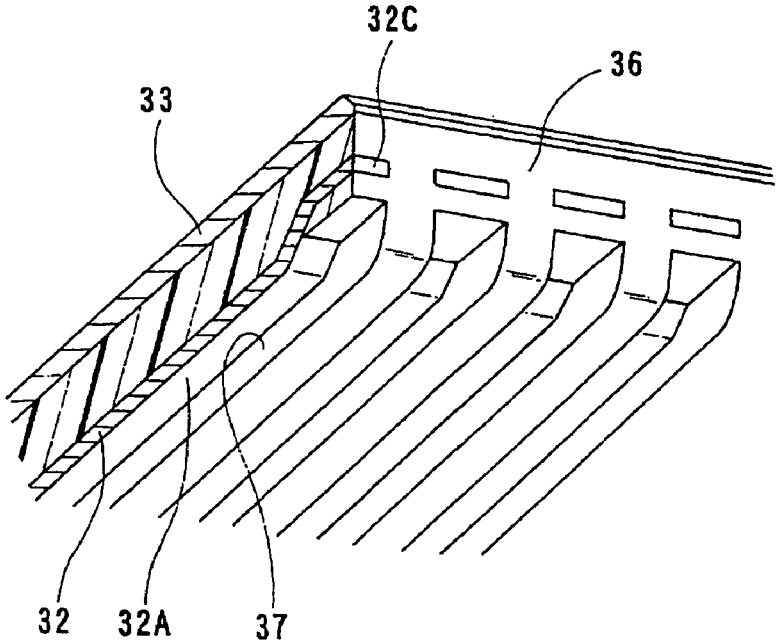
FIG. 4(B) is a sectional and perspective view of the contact section of a terminal.

The plug connector 30 includes a housing 31, terminals 32, a shield case 33, and a cover case 34. The housing 31 is made of an insulative material, such as a plastic, to provide a terminal retention section 35 and a plugging section 36 having a plate shape thinner than the terminal retention section 35 and extending forwardly from the terminal retention section 35. The terminal retention section 35 is molded together with the terminals 32 50 as to hold the intermediate sections. As FIGS. 4(A) and 4(B) show, the plugging section 36 has a plurality of grooves 37 for guiding the contact sections 4 of the terminals 1. The fixed contact sections 32A of the terminals 32 are closely attached to the bottoms of the grooves 37. The crank-shaped portions of the terminals 32 are retained by the terminal retention section 35 disposed alternately at up/down positions so that the rear connection sections 323 are arranged in two tiers. The front ends 320 of the terminals 32 are embedded in the housing to avoid collision with a mating connector. The contact sections 32A of the terminals 32 are located inside the grooves 37 so that no finger or the like can touch them easily.

Figure 5:
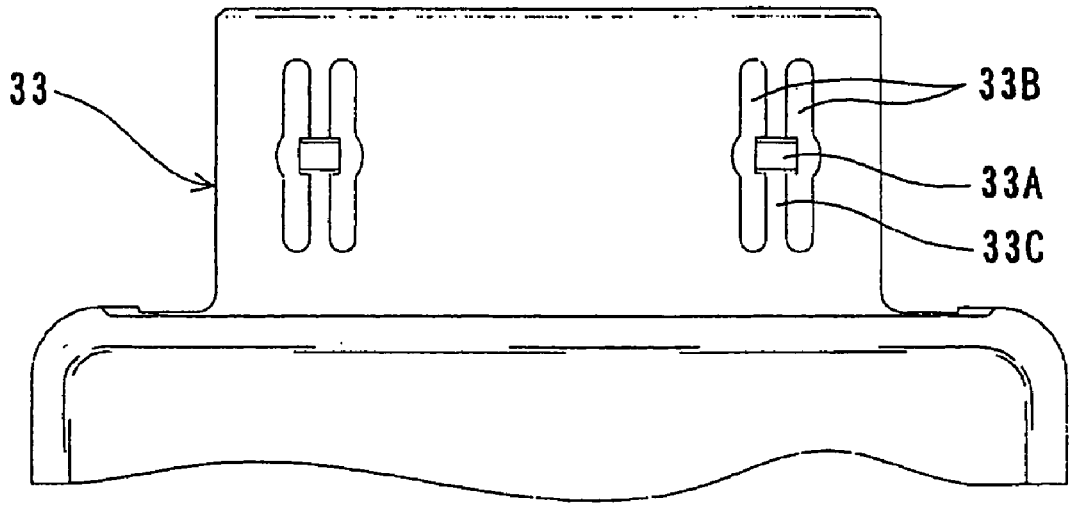
FIG. 5 is a plan view of the front portion of a shield case for the plug connector.

The shield case 33 is fitted over the housing 31. As FIG. 4(A) shows, it covers the upper half of the terminal retention section 35 and the plugging section 36 except for the lower intermediate section (which corresponds to the arranging plate 9 of the receptacle connector 20). A pair of projections 33A is provided on the shield case 33 for engagement with the lock holes 3D of the receptacle connector 20. As FIG. 5 shows, each project 33A is made by raising the center of a resilient strip 33C which is formed by a pair of grooves 33B so that it makes resilient movement upon engagement/disengagement with the lock hole 3D. Then, the upper and lower halves of the cover case 34 are attached to the housing 31 equipped with the shield case 33 as shown in FIG. 1. The projection 33A is widened to the size of the lock hole 3D to increase the locking power. Consequently, the groove 335 is curved outwardly at the position of the projection 33A.

The plugging section 36 of the plug connector 30 is plugged into the receptacle connector 20 provided on the circuit board P such that the terminal contact sections 4 of the receptacle connector 20 are brought into resilient contact with the fixed terminal contact sections 32A of the plug connector 30. The two connectors have only one outer wall in the plugging area so that the height of the plugged connectors becomes small. The shield case is made of a metal sheet which is so thin that it does not affect the height.

SECOND EMBODIMENT

Figure 6:
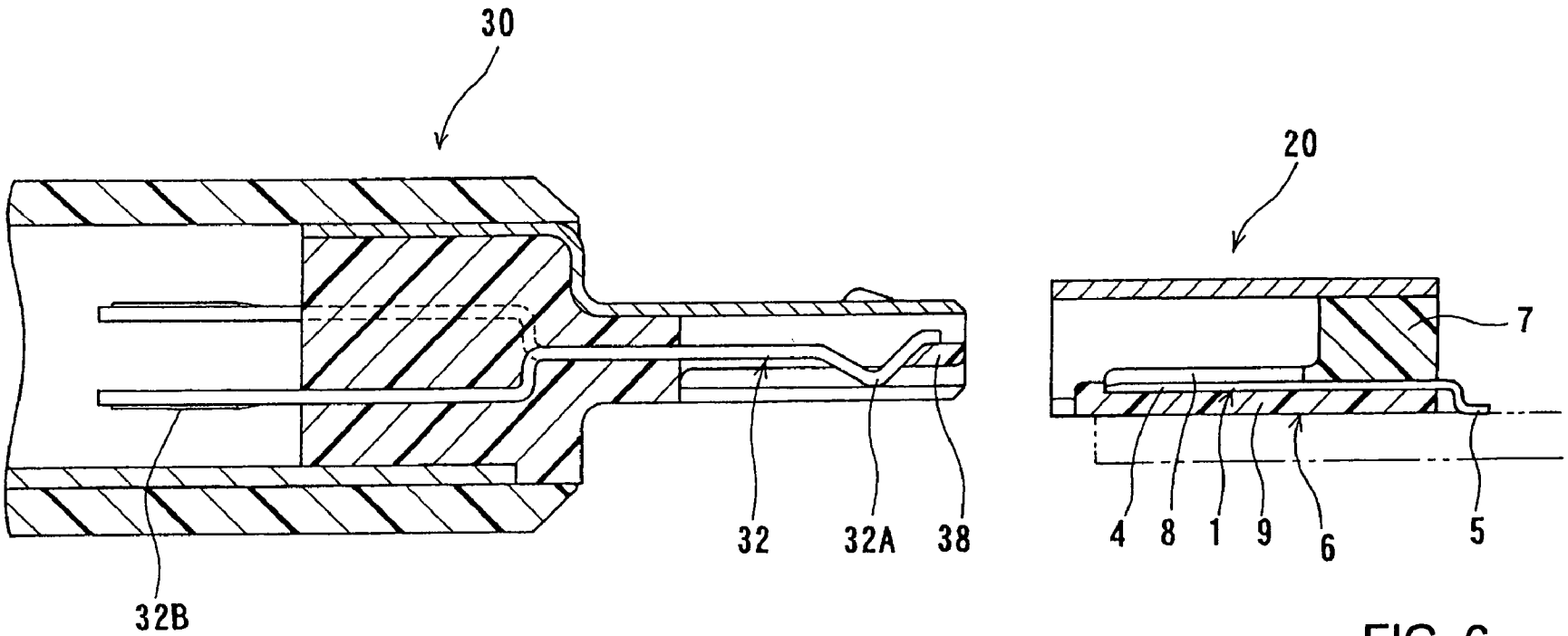
FIG. 6 is a sectional view of a receptacle connector and a plug connector according to the second embodiment of the invention.

The second embodiment in FIG. 6 has an opposite structure of the terminal contact sections of the receptacle connector 20 and the terminal contact sections of the plug connector of the first embodiment in FIG. 1. Hence, the terminal contact sections 4 of the receptacle connector 20 are fixed and the terminal contact sections 32A of the plug connector 30 are resilient. Each terminal contact section 32A has a front tip supported by the supporting portion 38 of the housing with a biasing force so that it is not only flexible upwardly upon plugging into the receptacle connector 20 but also stable when the plug connector 30 is not plugged into the receptacle connector 20.

Figure 7:
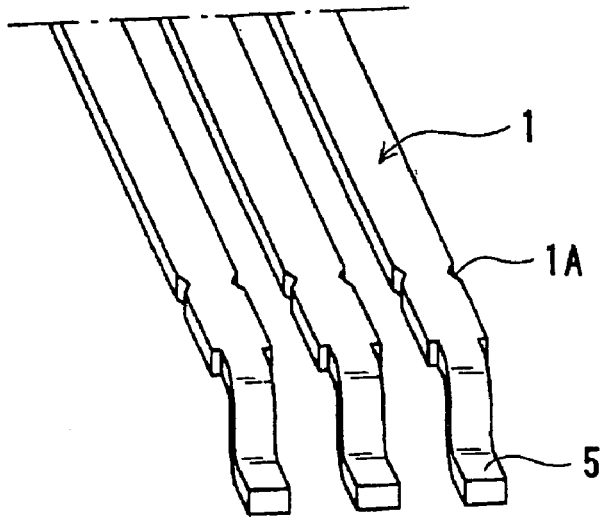
FIG. 7(A) is a perspective view of a portion of a terminal for the receptacle connector of FIG. 6.
FIG. 7(B) is a perspective view of the arranging grooves of a housing for the receptacle connector of FIG. 6.
Figure 7:
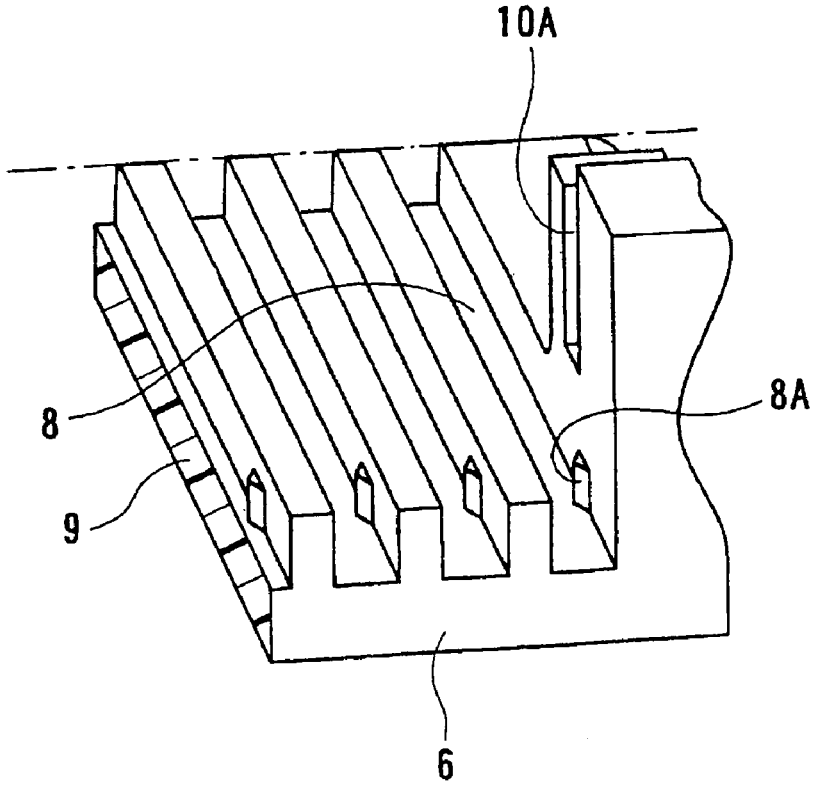

As shown in FIGS. 7(A) and 7(B), the terminal 1 has a pair of engaging notches 1A in the portion to be fitted into the arranging groove 8 of the housing body 6, and the arranging groove 8 has a pair of engaging projections 8A corresponding to the engaging notches 1A to prevent longitudinal movement or separation of the terminal 1 from the arranging groove 8. This structure may be used for the first embodiment.

Figure 8:
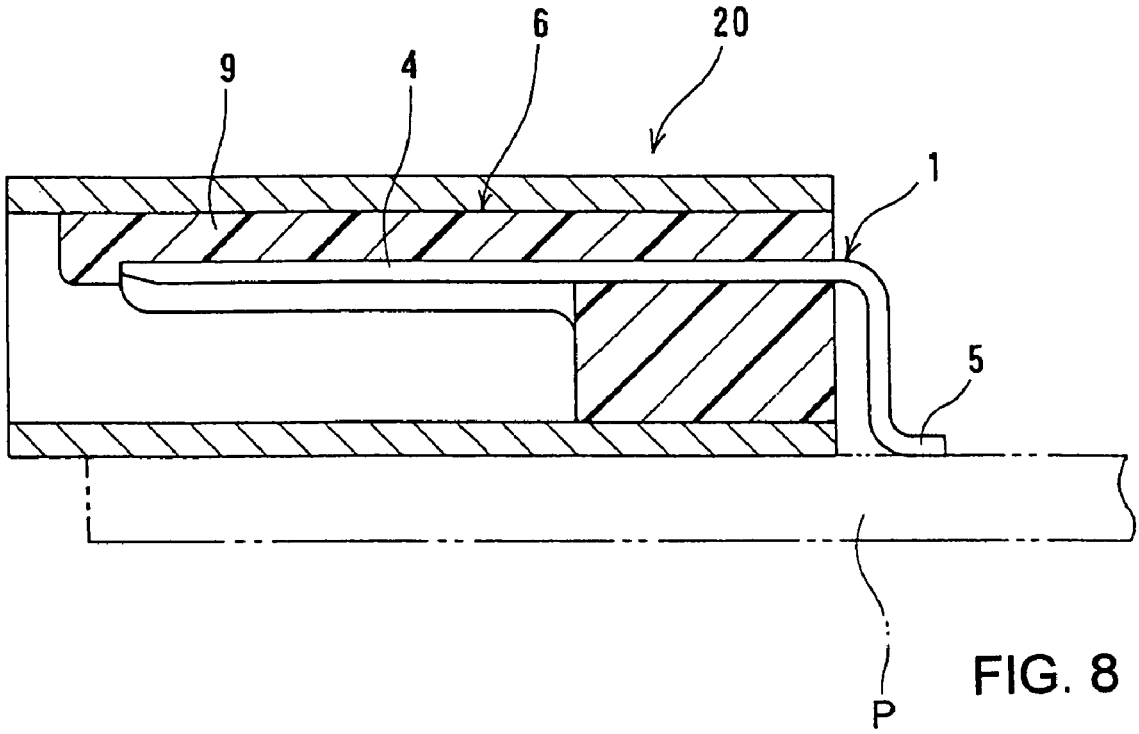
FIG. 8 is a sectional view of a receptacle connector according to a variation of the second embodiment.

FIG. 8 shows a variation of the second embodiment, wherein the housing of the receptacle connector 20 is inverted. A single outer wall of the housing constitutes the arranging plate 9 on which the contact section 4 is placed, thus minimizing the connector. Unlike the embodiment of FIG. 1, the housing is not divided into the housing body and the holding member but is made as a single member. The terminal is inserted into the insertion hole or molded integrally with the housing.

What is claimed is:

1. An electrical connector comprising:

a housing having an outer wall, at least one arranging plate connected to the housing, said arranging plate being exposed when said electrical connector is plugged to a mating connector, and a plurality of terminals each having a contact section arranged on said arranging plate with a predetermined interval for electrically contacting a contact section of the mating connector when said electrical connector is plugged to said mating connector, wherein said electrical connector is a receptacle connector provided on a circuit board for receiving said mating connector in a direction parallel to said circuit board, said arranging plate including an arranging groove having a depth sufficiently deep to house said contact section therein, said housing including a housing body and a holding member to form a retention section for retaining an intermediate portion of said terminal, said housing body having a retention groove communicating with said arranging groove.

2. The electrical connector according to claim 1, wherein said contact section of said terminal is raised from said arranging plate and is flexible.

3. The electrical connector according to claim 1, wherein said contact section of said terminal is fixed closely to said arranging plate.

4. The electrical connector according to claim 1, further comprising a shield case for covering said housing.

5. The electrical connector according to claim 1, wherein said housing includes an upper portion, side portions, and a bottom portion with an opening, said arranging plate being disposed in the opening and fixed to the bottom portion such that side edges of the arranging plate are situated away from the side portions to form side spaces for receiving a portion of the mating connector.

* * * * *